US006628055B2

(12) United States Patent
Park

(10) Patent No.: US 6,628,055 B2
(45) Date of Patent: Sep. 30, 2003

(54) SHADOW MASK IN CATHODE RAY TUBE

(75) Inventor: Yoon San Park, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 361 days.

(21) Appl. No.: 09/768,247

(22) Filed: Jan. 25, 2001

(65) Prior Publication Data

US 2001/0017511 A1 Aug. 30, 2001

(30) Foreign Application Priority Data

Feb. 1, 2000 (KR) ..... 2000-4793

(51) Int. Cl.[7] ..... H01J 29/80
(52) U.S. Cl. ..... 313/402
(58) Field of Search ..... 313/402, 403, 313/407, 404, 405, 406

(56) References Cited

U.S. PATENT DOCUMENTS 5,616,985 A * 4/1997 Hosotani ..... 313/403
6,057,640 A * 5/2000 Aibara ..... 313/403
6,097,142 A * 8/2000 Ko ..... 313/402
6,313,574 B1 * 11/2001 Banno et al. ..... 313/402
6,423,160 B1 * 7/2002 Arimoto et al. ..... 148/325

FOREIGN PATENT DOCUMENTS

JP 52022474 * 2/1977 ..... 313/403

* cited by examiner

*Primary Examiner*—Max Noori

(57) ABSTRACT

Shadow mask in a cathode ray tube including an effective surface, and a non-effective surface, wherein the effective surface includes elongated slots each extended in full length of the effective surface without bridges between slots in a vertical direction at left and right outermost sides of the shadow mask or outer side slots adjacent to the outermost side slots, thereby preventing wrinkles from being formed at sides of an effective surface to enhance a color purity of the picture.

2 Claims, 7 Drawing Sheets

SHADOW MASK IN CATHODE RAY TUBE

BACKGROUND OF THE INVENTION

1. Field of the Invention

The present invention relates to a shadow mask in a cathode ray tube, and more particularly, to a shadow mask in a cathode ray tube, which has a structure that can prevent formation of wrinkles and improve deterioration of purity characteristics caused by the formation of wrinkles.

2. Background of the Related Art

Referring to FIG. 1, a related art color cathode ray tube is provided with a front glass called as a panel 10, a funnel 12, a bulb form of rear glass, a fluorescent surface 11 having a coat of luminous fluorescent material on an inside surface of the panel, an electron gun sealed in a neck of the funnel for emitting electron beams to make the fluorescent surface luminous, a shadow mask 13 for selecting a color from the electron beams passed therethrough to make the fluorescent material luminous, and a frame 15 for supporting the shadow mask 13. A frame assembly of the frame 15 and the shadow mask 13 is fitted to the panel 10 by springs 16. Further, there is an inner shield 17 in rear of the frame assembly in the cathode ray tube which is at a high vacuum for shielding an influence of an external geomagnetism during operation of the cathode ray tube.

In the related art color cathode ray tube, upon application of an anodic voltage to the cathode ray tube, the electron beams are emitted from the electron gun, and hit onto the fluorescent surface 11 formed on the inside surface of the panel 10, which are deflected by a deflection yoke 14 in an up, down, left, or right direction before the electron beams reach to the fluorescent surface 11. The deflected electron beams are subjected to color selection as the electron beams pass through a plurality of slots in the shadow mask, land on the fluorescent material of the fluorescent surface, and make the fluorescent material luminous, to reproduce a picture.

The shadow mask is welded to a frame structure shown in FIG. 2A, which is shown in FIG. 2B as a top view and in FIG. 2C as a perspective view. One pair of main frames 15-1 and subframes 15-2 are welded together to form a rectangular frame, wherein the pair of the main frames 15-1 are welded on the pair of subframes which are arrange opposite to each other opposite to each other. The shadow mask 13 having a plurality of slots formed therein as shown in FIG. 2B is welded on such a frame structure. A frame assembly as shown in FIG. 2C is formed by welding the shadow mask 13 on top of the main frames under a state the subframes 15-2 are bent by a compressive load T applied to the main frames 15-1 and releasing the compressive load applied to the main frames, to exert a tensile force to the shadow mask 13. If an amount of elongation by the frames are not adequate, the pre-stressed shadow mask 13 assembled thus shows a serious howling caused by external vibration. Though howling in a central portion of the pre-stressed shadow mask 13 is not distinctive because an incident angle of the electron beams to the central portion is not great even if the shadow mask vibrates in an up or down direction by an external impact, the howling in a periphery and corners of the pre-stressed shadow mask 13 is distinctive because the incident angle of the electron beams to the periphery and corners of the shadow mask is great to move the electron beams heavily such that the electron beams can not land on the fluorescent material exactly, to deteriorate a color purity of the picture. Therefore, as shown in FIG. 3, the compressive load on the main frame 15-1 is made to vary with location of the main frame 15-1, and a thickness of the shadow mask 13 is set to be below 0.1 mm for an adequate elongation of the shadow mask by means of a little compressive load. However, as shown in FIGS. 4 and 5, the effective surface 13-1 having the slots formed therein and the non-effective surface 13-2 having no slots formed therein of the pre-stressed shadow mask 13 have different modulus of elasticity owing to difference of geometry of structure, that is, the modulus of elasticity of the effective surface 13-1 is smaller than the modulus of elasticity of the non-effective surface 13-2, to have a displacement δ of the effective surface 13-1 greater than a displacement of the non-effective surface 13-2, to form wrinkles at left and right sides ("A" part) of the effective surface 13-1 as much as a difference of the displacements. The wrinkles at the sides ("A" part) of the effective surface 13 deforms the shadow mask 13, to change locations of the slots the electron beams pass therethrough, resulting in a poor color purity of the picture reproduced on the cathode ray tube.

SUMMARY OF THE INVENTION

Accordingly, the present invention is directed to a shadow mask in a cathode ray tube that substantially obviates one or more of the problems due to limitations and disadvantages of the related art.

An object of the present invention is to provide a shadow mask in a cathode ray tube, which can prevent wrinkles from being formed at sides of an effective surface for enhancing a color purity of the picture.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the shadow mask in a cathode ray tube includes an effective surface, and a non-effective surface, wherein the effective surface includes elongated slots each extended in full length of the effective surface without bridges between slots in a vertical direction at left and right outermost sides of the shadow mask or outer side slots adjacent to the outermost side slots.

The elongated slot has a width expressed by the following inequality.

$$SWm < SWg \leqq SWm + (+\delta y)/3,$$

where, SWg denotes width of the elongated slot, SWm denotes a width of conventional slot, and +δy denotes a vertical elongation of the shadow mask.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
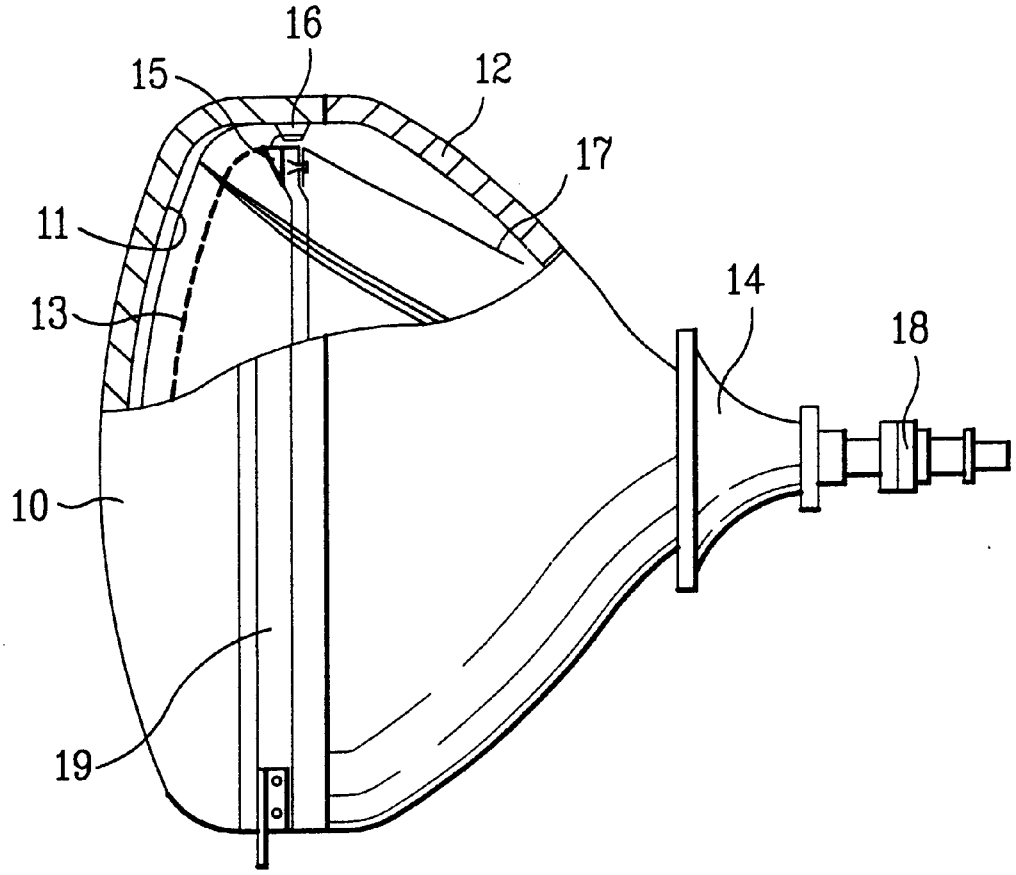
FIG. 1 Related Art
FIG. 1 illustrates a side view with a partial cut away view of a related art cathode ray tube.
Figure 2A:
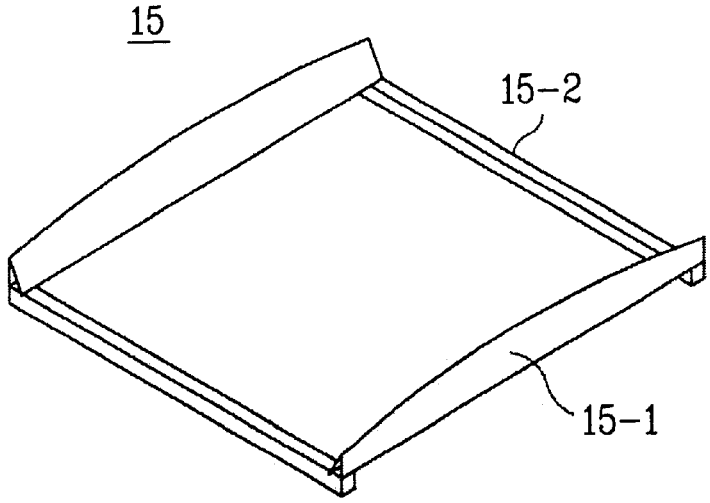
FIG. 2A Related Art
FIGS. 2A~2C illustrate perspective views for showing assembly of a related art shadow mask.
Figure 2B:
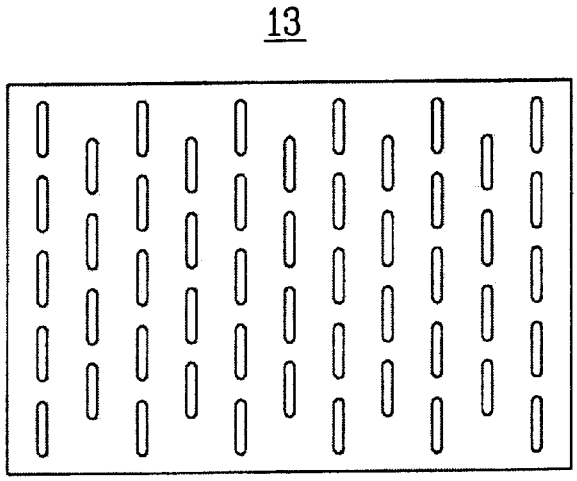
FIG. 2B Related Art
Figure 2C:
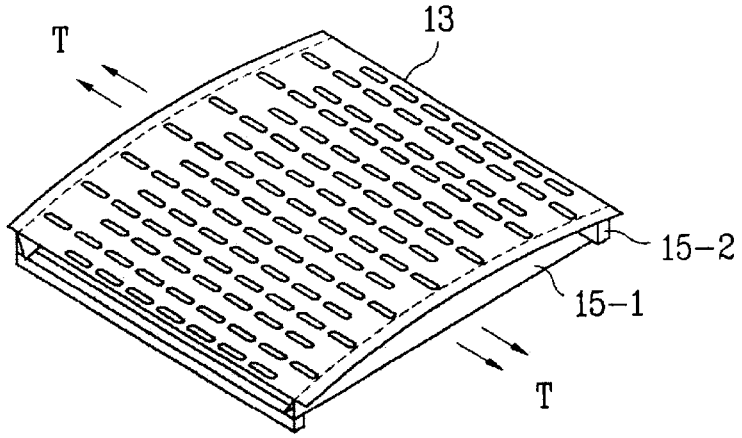
FIG. 2C Related Art
Figure 3:
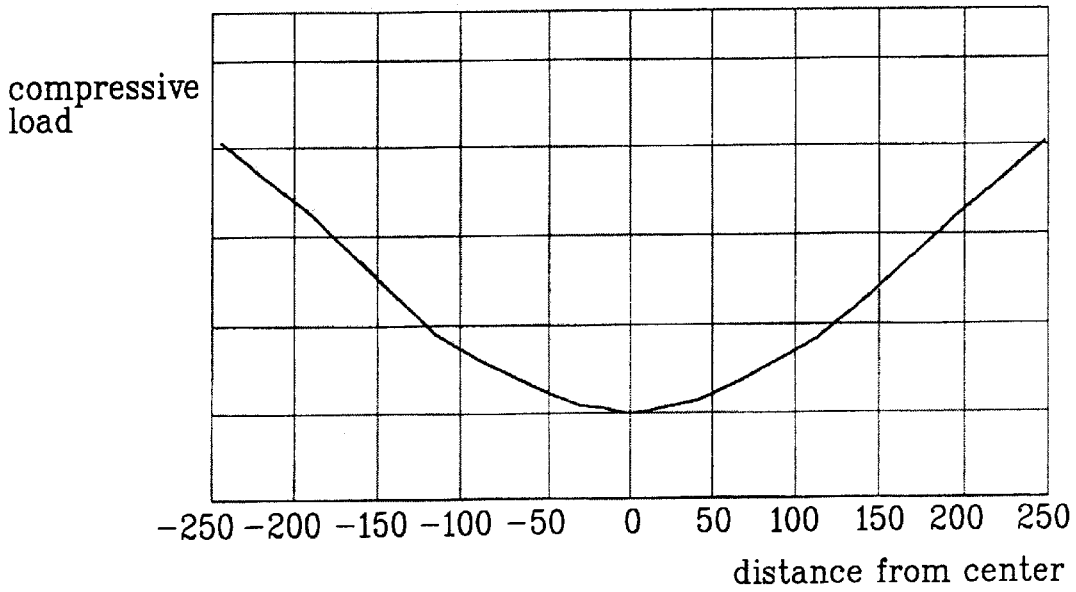
FIG. 3 Related Art
FIG. 3 illustrates a graph showing a compressive force vs. a distance in a longitudinal direction of a main frame.
Figure 4:
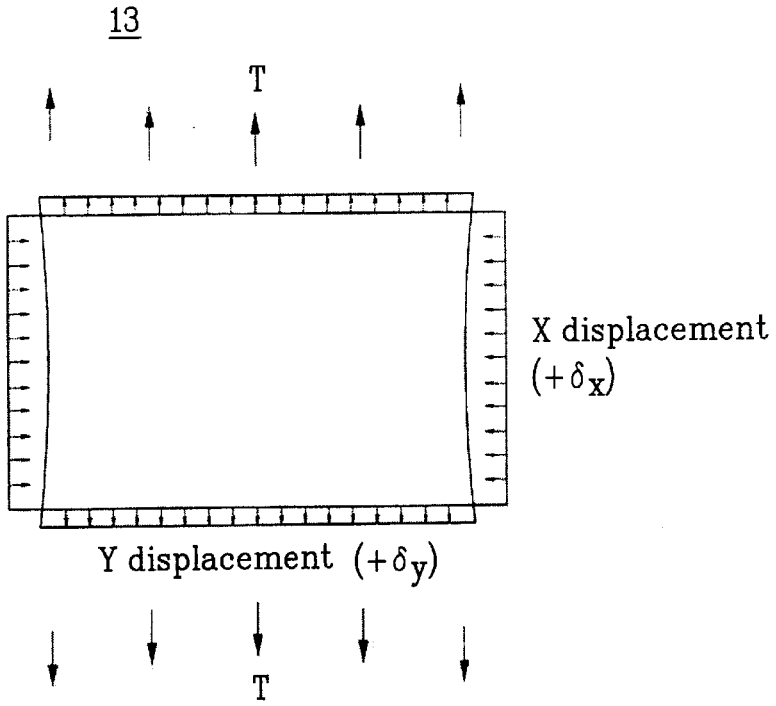
FIG. 4 Related Art
FIG. 4 illustrates displacements of a shadow mask in up, down, left and right directions, schematically.
Figure 5:
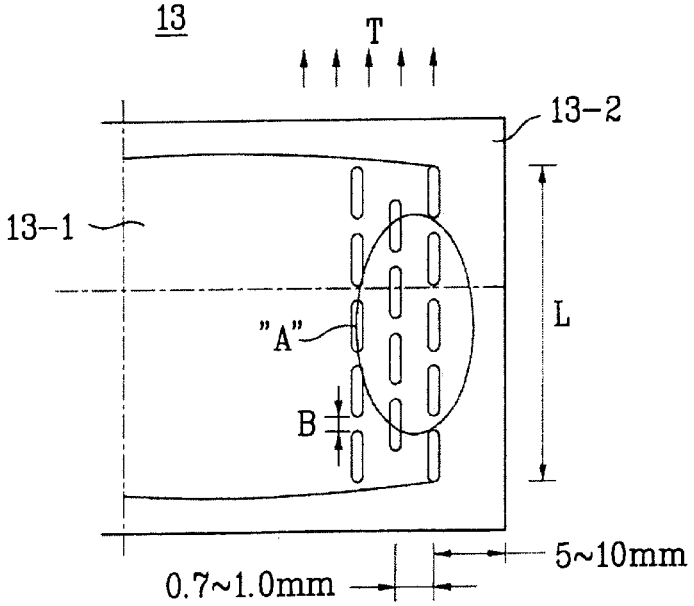
FIG. 5 Related Art
FIG. 5 illustrates behaviour of a related art shadow mask when subjected to a tensile strength.
Figure 6:
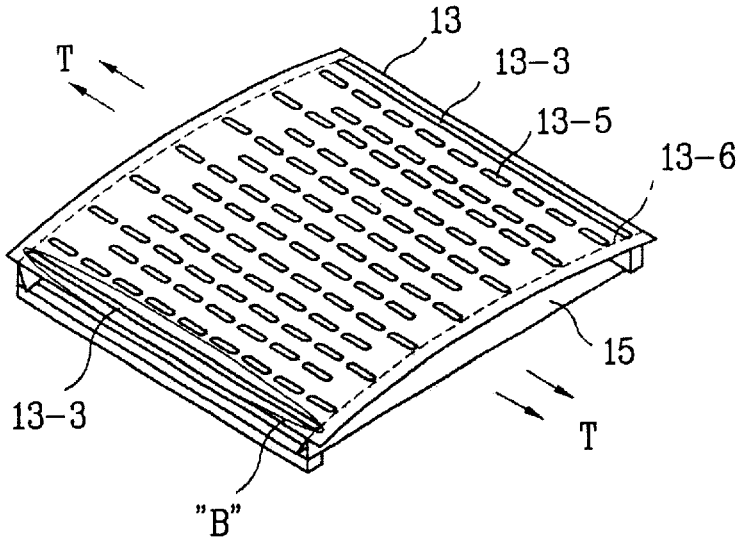
FIG. 6 illustrates a perspective view showing a shadow mask assembly in accordance with a preferred embodiment of the present invention.

Reference will now be made in detail to the preferred embodiments of the present invention, examples of which are illustrated in the accompanying drawings. FIG. 6 illustrates a perspective view showing a shadow mask assembly in accordance with a preferred embodiment of the present invention, FIGS. 7A~7D illustrate stresses in a shadow mask of the present invention, schematically, and FIGS. 8A~8B illustrate a slot structure of a shadow mask of the present invention schematically, referring to which the shadow mask of the present invention will be explained.

Referring to FIG. 6, the shadow mask assembly in accordance with a preferred embodiment of the present invention includes a shadow mask 13 having an effective surface 13-1 with slots for selecting a color from electron beams and a non-effective surface 13-2 to be welded to the frame 13 with no slots for selection of a color, and a frame 15 for fitting the shadow mask to a panel 10, wherein the shadow mask is welded to a welding line 13-6 formed along long sides of the non-effective surface 13-2. There is an elongated color selection slot 13-3 in each of outer most sides of the effective surface 13-1 in a form bridges of the slots are removed therefrom. In detail, the pre-stressed shadow mask 13 fitted to the frame is elongated by more than 0.1% (0.240 mm)+δy of a length of a vertical effective surface in a vertical direction (y-axis direction) when a tension T is applied thereto. In this instance, the shadow mask 13 is involved in shrinkage at left and right sides thereof by approx. ⅓(0.7 mm)−δx of the vertical elongation toward a center of the shadow mask 13 inversely proportional to the vertical elongation according to a Poisson's Ratio. In a structure of the slot type shadow mask 13, the modulus of elasticity of the effective surface 13-1 is lower than the modulus elasticity of the non-effective surface 13-2 owing to existence of slots, i.e., a difference of geometry of the effective surface 13-1 and the non-effective surface 13-2. That is, as expressed by equation (1) below, the difference of modulus of elasticity makes the displacement δ of the effective surface 13-1 greater than the displacement δ of the non-effective surface 13-2.

$$\delta=(P\times L)/(A\times E) \quad (1),$$

where, P denotes tensile strength, L denotes a length, A denotes a sectional area, and E denotes a modulus of elasticity.

Figure 7A:
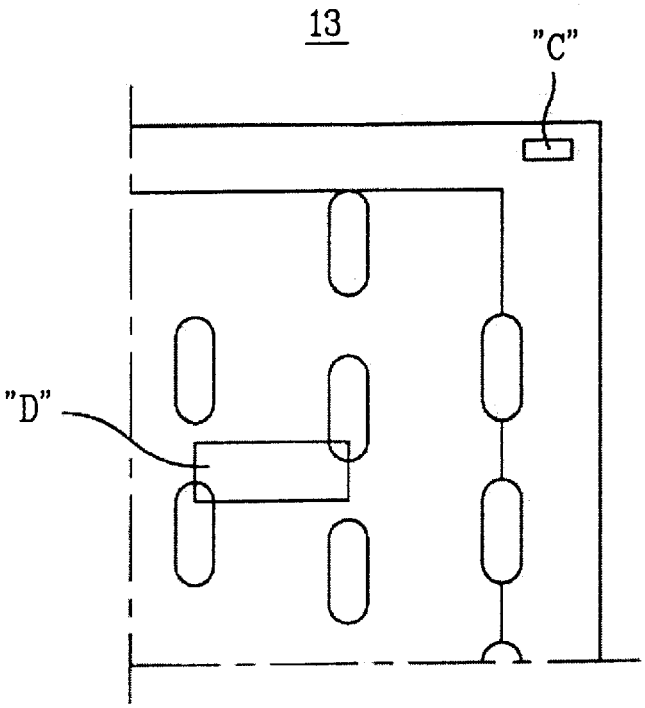
FIGS. 7A~7D illustrate stresses in a shadow mask of the present invention, schematically; and, FIGS. 8A~8B illustrate a slot structure of a shadow mask of the present invention, schematically.
Figure 7B:
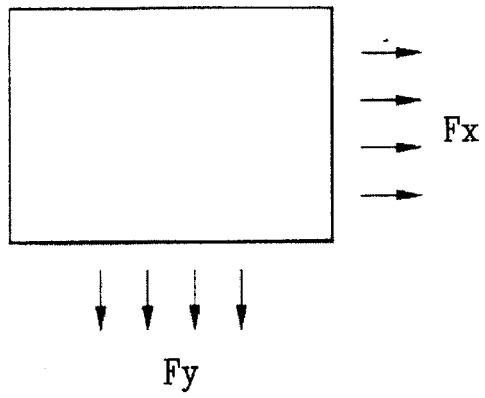
Figure 7C:
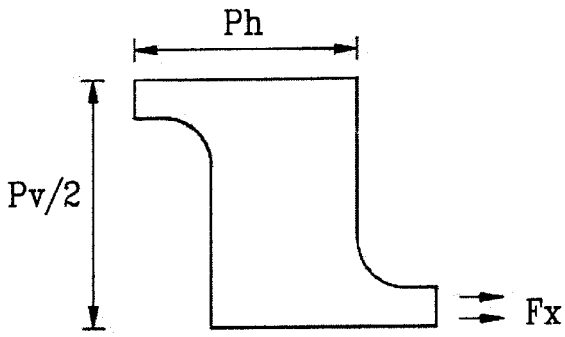
Figure 7D:
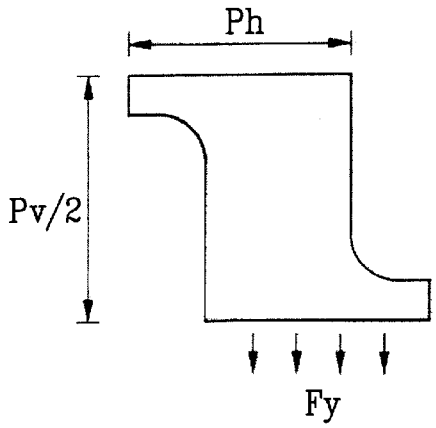
Figure 8A:
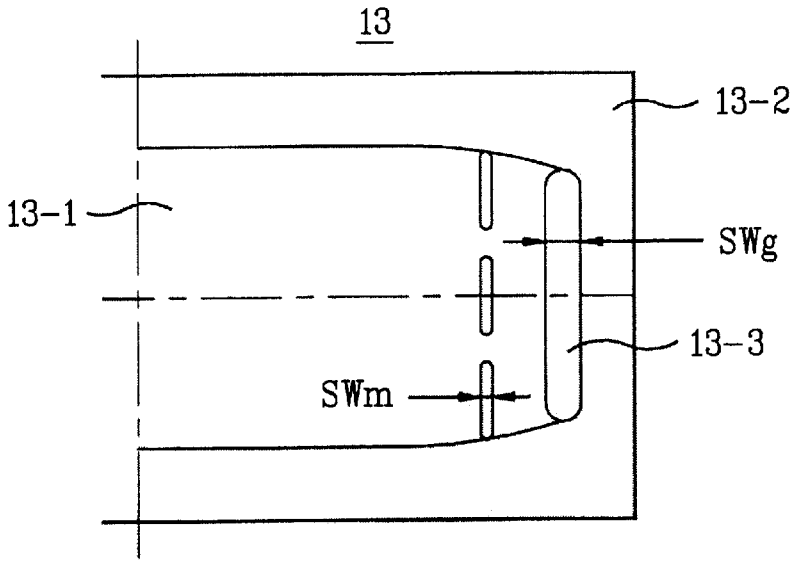
Figure 8B:
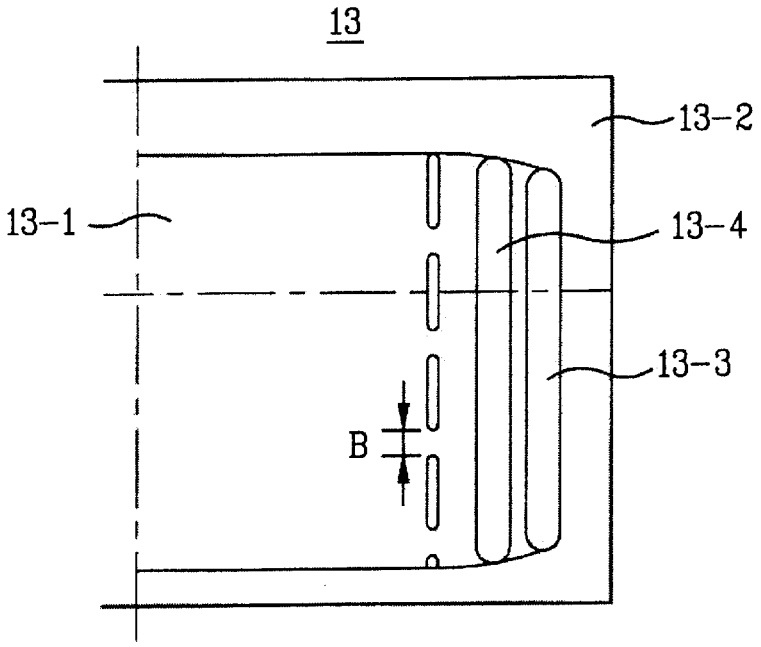

FIGS. 7A~7D illustrate stresses in a shadow mask of the present invention schematically, wherein FIG. 7A illustrates an edge portion of the shadow mask, FIG. 7B explains a modulus of elasticity of a non-effective surface, and FIGS. 7C and 7D illustrate a modulus of elasticity of an effective surface.

Referring to FIG. 7B, in the non-effective surface 13-2 without the slots of the shadow mask of isotropic material with uniform properties, an effective modulus of elasticity can be expressed in equation (2), below.

$$(Ex)eff=\delta x/\epsilon x, \text{ and } (Ey)eff=\delta y/\epsilon y, \quad (2)$$

$$\therefore (Ex)eff=(Ey)eff,$$

where, Fx and Fy denotes tensions in respective directions applied to the non-effective surface, (δx)eff and (δy)eff denote stresses in the non-effective surface 13-2, and (ϵx)eff and (ϵy)eff denote strains in respective directions.

However, as shown in FIGS. 7C and 7D, since the effective surface 13-1 is orthotropic material in which the slot has horizontal and vertical lengths different from each other, and shows different stresses and strains when a tension is applied thereto in x-, and y-directions, the following equation (3) can be established.

$$(Ex)eff=\delta x/\epsilon x=Fx/(Pv/2), \text{ and } (Ey)eff=\delta y/\epsilon y=Fy/Ph \quad (3)$$

$$\therefore (Ex)eff\neq(Ey)eff,$$

where, Fx and Fy denotes tensions in respective directions applied to the effective surface, (δx)eff and (δy)eff denote stresses in the effective surface, and (ϵx)eff and (ϵy)eff denote strains in respective directions. That is, since the effective surface 13-1 of the shadow mask 13 has a greater stresses and strains in x-, and y-directions than the non-effective surface 13-2, the effective surface 13-1 of the shadow mask 13 has a modulus of elasticity greater than the non-effective surface 13-2. As strains of the effective surface 13-1 and the non-effective surface derived from the equation (1) are different, by removing bridges 'B' of the outermost slots to form one elongated slot, the wrinkles caused by a difference of displacements of the effective surface 13-1 and the non-effective surface 13-2 can be eliminated.

When the shadow mask is elongated in up and down directions, since the non-effective surface 13-2 shrinks toward the center of the shadow mask 13 according to the Poisson's ratio, x-direction shrinkage is in general approx. 30% of y-direction elongation, i.e., $$x\text{-direction shrinkage}-\delta x\approx\tfrac{1}{3}\times(+\delta y),$$

where, +δy denotes a y-direction elongation, and −δx denotes an x-direction shrinkage.

Therefore, since a width SWg of the outermost slot contracts when the shadow mask is elongated in up and down directions, it is preferable to set the width SWg of the outermost slot greater by an amount of the contraction in x-direction, as follows.

$$SWm<SWg\leq SWm+(+\delta y)/3 \quad (4).$$

It is apparent that the present invention may be modified or varied such that the widths of the slots are formed the smaller as it goes inward, or not only the outermost slots, but also inner slots adjacent to the outermost slots may be elongated.

FIG. 8A illustrates an enlarged plan view of "B" part in FIG. 6, wherein the elongated outermost slot of the shadow mask 13 is shown to have a width greater than inner conventional slots. FIG. 8A illustrates an enlarged plan view of "B" part in FIG. 6 in accordance with another preferred embodiment of the present invention, wherein, not only the outermost slots 13-3 of the effective surface, but also adjacent inner slots of the outermost slots 13-4 are also elongated, to provide a plurality of elongated slots.

As has been explained, the shadow mask in a cathode ray tube of the present invention has the following advantages.

By removing bridges of outermost slots in left and right effective surfaces of the shadow mask a vertical direction tension is applied thereto, to provide an elongated slot, the poor color purity caused by deformation of the shadow mask can be improved. Moreover, by eliminating a non-uniform factor in which wrinkles at sides of the effective surface are formed the more as the vertical tension becomes the greater, and vice versa, design for elongation which gives an influence to howling becomes easy since formation of the wrinkles are prevented regardless of the elongation.

It will be apparent to those skilled in the art that various modifications and variations can be made in the shadow mask in a cathode ray tube of the present invention without departing from the spirit or scope of the invention. Thus, it is intended that the present invention cover the modifications and variations of this invention provided they come within the scope of the appended claims and their equivalents.

What is claimed is:

1. A shadow mask in a cathode ray tube comprising:

an effective surface; and, a non-effective surface, wherein the effective surface includes elongated slots each extended in full length of the effective surface without bridges between slots in a vertical direction at left and right outermost sides of the shadow mask or outer side slots adjacent to the outermost side slots.

2. A shadow mask as claimed in claim 1, wherein the elongated slot has a width expressed by the following inequality.

$$SWm < SWg \leqq SWm + (+\delta y)/3,$$

where, SWg denotes width of the elongated slot, SWm denotes a width of conventional slot, and +δy denotes a vertical elongation of the shadow mask.

* * * * *